US005248266A

United States Patent [19]

Clyatt, III et al.

[11] Patent Number: 5,248,266

[45] Date of Patent: Sep. 28, 1993

[54] CONNECTOR WITH SEALED COMPONENT CONTACT

[75] Inventors: Clarence L. Clyatt, III, Goodyear; Eric J. Paulus, Scottsdale, both of Ariz.

[73] Assignee: ITT Coporation, Secaucus, N.J.

[21] Appl. No.: 945,795

[22] Filed: Sep. 15, 1992

[51] Int. Cl.[5] ..... H01R 13/66

[52] U.S. Cl. ..... 439/620; 333/185

[58] Field of Search ..... 439/608, 620, 936; 333/181-185

[56] References Cited

U.S. PATENT DOCUMENTS

| | | | |
|---|---|---|---|
| 2,304,764 | 12/1939 | McAllister | 173/324 |
| 3,200,355 | 8/1965 | Dahlen | 333/79 |
| 3,569,915 | 3/1971 | Sorensen et al. | 439/608 |
| 4,582,385 | 4/1986 | Couper et al. | 439/620 |
| 4,734,663 | 3/1988 | Focht | 333/182 |
| 4,768,977 | 9/1988 | Gliha, Jr. et al. | 439/620 |
| 4,789,360 | 12/1988 | Paul et al. | 439/620 |
| 4,820,174 | 4/1989 | Farrar et al. | 439/95 |
| 4,820,196 | 4/1989 | Roselle et al. | 439/936 |
| 4,846,732 | 7/1989 | Meelhuysen | 439/620 |
| 4,954,794 | 9/1990 | Nieman et al. | 333/182 |
| 5,046,968 | 9/1991 | Baur et al. | 439/620 |
| 5,195,014 | 3/1993 | Krantz, Jr. et al. | 439/620 |

FOREIGN PATENT DOCUMENTS 3416905 1/1986 Fed. Rep. of Germany .

*Primary Examiner*—Gary F. Paumen

*Attorney, Agent, or Firm*—Thomas L. Peterson

[57] ABSTRACT

A connector contact is described, of the type that has a platform (50, FIG. 2) which holds a circuit component (52) and a grounding conductor (54), which provides hermetic sealing of the component. The circuit component has bottom and top terminals (70, 72, FIG. 5) each joined by a coupling layer (74, 76) of high surface energy material such as solder, respectively to the platform and to a finger (60) of the grounding conductor. Each coupling layer overhangs the circuit component to leave a surrounding layer portion (80, 82). An encapsulant includes a moisture-proof inner portion (90) which surrounds the component and which extends between and bonds to the surrounding portions (80, 82) of the lower and upper coupling layers.

17 Claims, 5 Drawing Sheets

FIG. 1
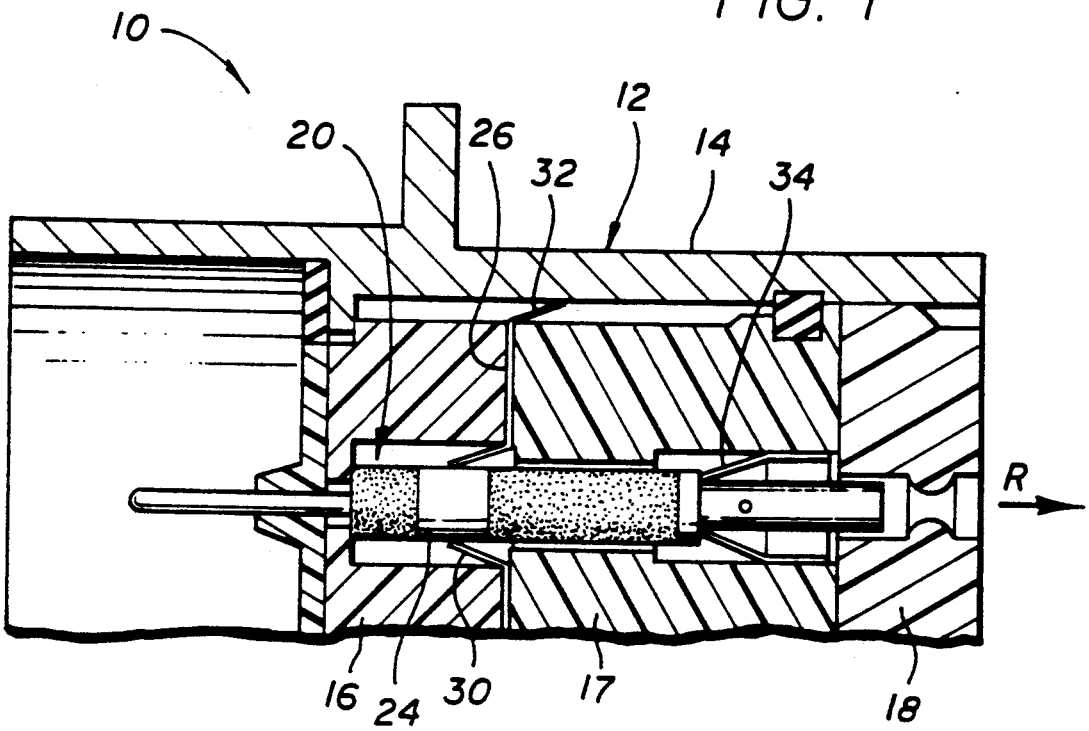
FIG. 2
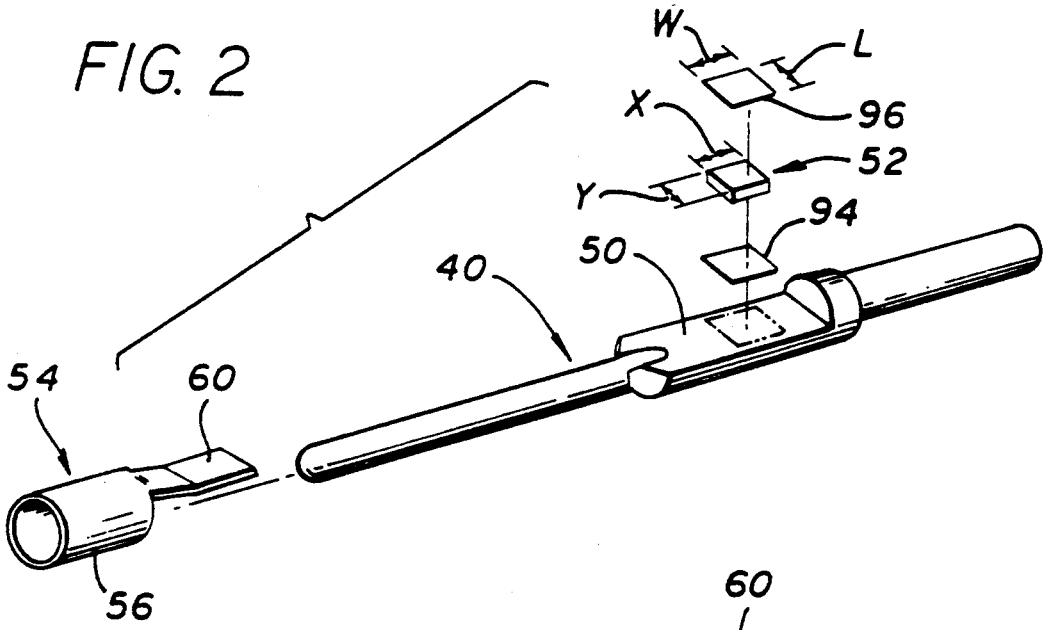
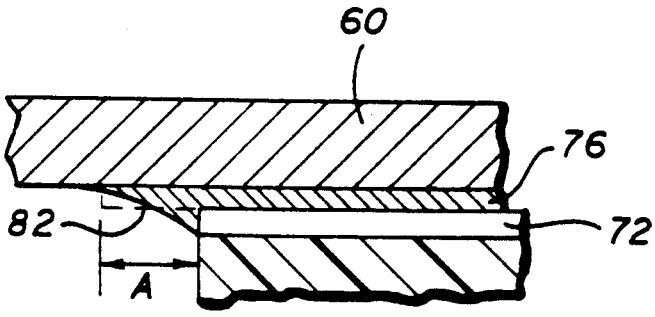
FIG. 6

FIG. 10
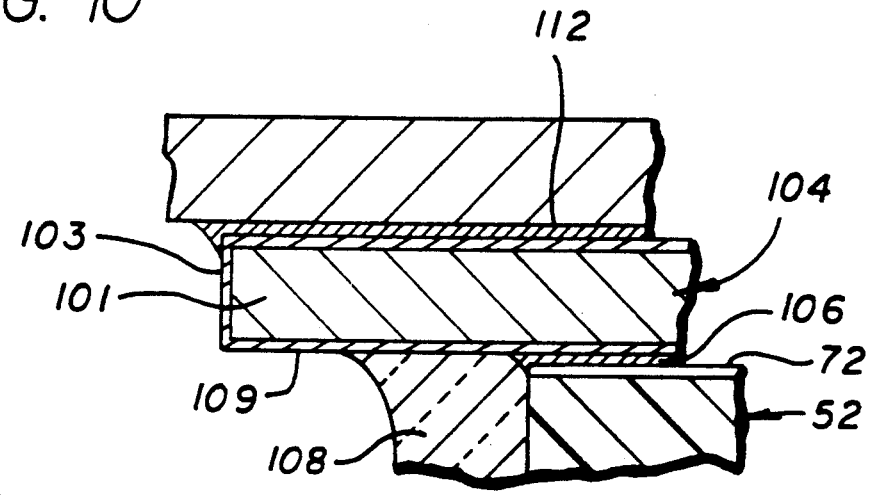
FIG. 11
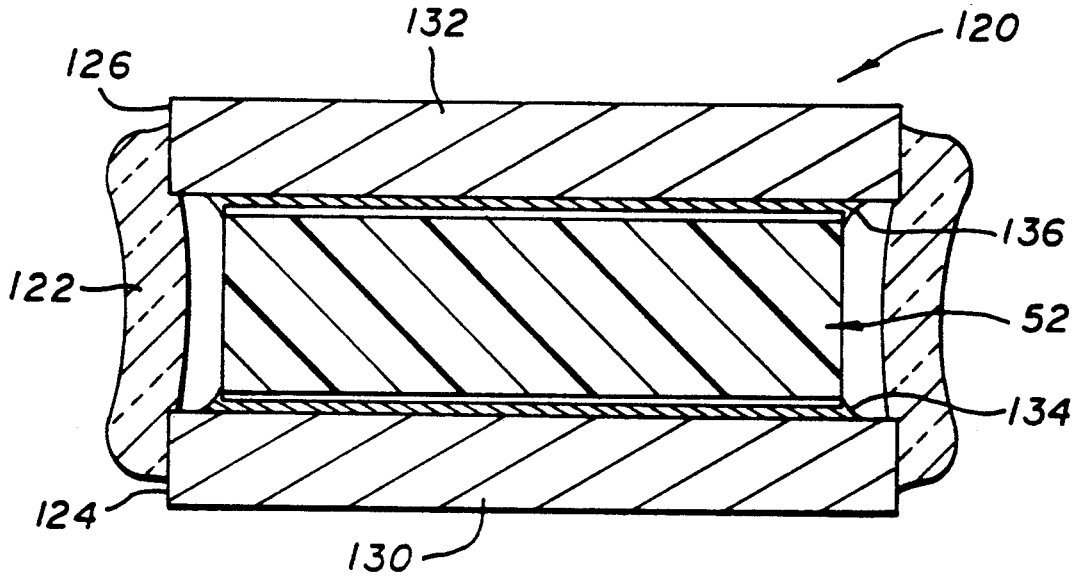
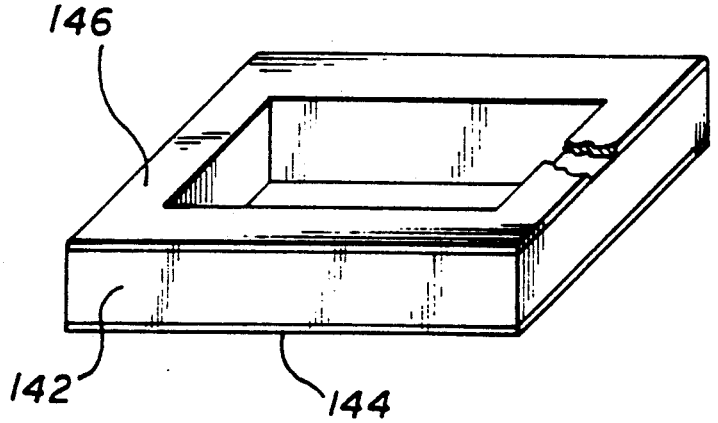
FIG. 13

CONNECTOR WITH SEALED COMPONENT CONTACT

BACKGROUND OF THE INVENTION

Some connectors are constructed so each of their contact assemblies holds at least one circuit component such as a high energy pulse-dissipating diode, and a grounding conductor for connection to a ground plane. U.S. Pat. No. 4,954,794 by the present inventors and others, describes contact assemblies of this type, wherein the circuit component and surrounding portions of the contact and grounding conductor are encapsulated with epoxy. While the epoxy is durable and can bond to the various parts of the contact assembly for good mechanical strength, the epoxy encapsulant is not highly effective in keeping moisture from the circuit component, that is, moisture can penetrate through the epoxy encapsulant. Other encapsulants are available, but they generally cannot bond well to the surfaces of the parts of the contact assembly. For example, the grounding conductor may be gold plated, and gold has a relatively low surface energy which results in difficulty of bonding many encapsulating materials to the surface. A component contact assembly which included an encapsulant that reliably sealed the circuit component from moisture would be of considerable value.

SUMMARY OF THE INVENTION

In accordance with one embodiment of the present invention, a connector is provided which has contact assemblies that hold circuit components, which provides hermetic sealing for the components. Each contact assembly includes a contact with a middle which may form a platform, a circuit component with a lower terminal mounted on the platform, and a grounding conductor with a rearward portion coupled to the upper terminal of the component. A lower coupling layer lies between the lower terminal and the platform, while an upper coupling layer lies between the upper terminal and the grounding conductor. Each coupling layer is of high surface energy material such as solder, and overhangs the corresponding terminal to leave a surrounding layer portion which surrounds the corresponding terminal. An encapsulant includes a moisture-proof inner portion which surrounds the component and which extends between and bonds to the surrounding portions of both the lower coupling layer and the upper coupling layer, to thereby provide a moisture seal around the component. The inner portion of the encapsulant can be of the type that has relatively poor bonding qualities, because it can bond to the high surface energy material of the coupling layers.

In one contact assembly, each contact layer is formed by a solder preform which is considerably wider and longer than the component terminals to overhang them. The solder is a high temperature solder, which melts at a temperature higher than the curing temperature of the inner portion of the encapsulant. In another contact assembly, a wide overhanging metal plate is presoldered to each terminal of the circuit component with a high melting temperature solder, and a moisture-proof encapsulant surrounds the component and bonds to the metal plates. The unit consisting of the component, metal plates, and inner encapsulant, can be installed on the connector by soldering the plates respectively to the contact platform and to the rearward portion of the grounding conductor with low melting temperature solder. In another embodiment of the invention, the inner portion of the encapsulant is formed by a rigid barrier which surrounds but does not bond to the circuit component, and which is itself soldered respectively to the platform and to the rearward portion of the grounding conductor.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partial sectional side view of a connector constructed in accordance with the present invention.

FIG. 2 is an exploded isometric view of the contact assembly of the connector of FIG. 1, but without the encapsulant thereof.

FIG. 6 is an enlarged view of the region 6—6 of the connector of FIG. 5, but without the encapsulant.

FIG. 10 is an enlarged view of a portion of the assembly of FIG. 7.

FIG. 11 is a sectional view of a component unit constructed in accordance with another embodiment of the invention.

FIG. 13 is an isometric view of the barrier of the contact assembly of FIG. 12.

DESCRIPTION OF THE PREFERRED EMBODIMENTS

Figure 3:
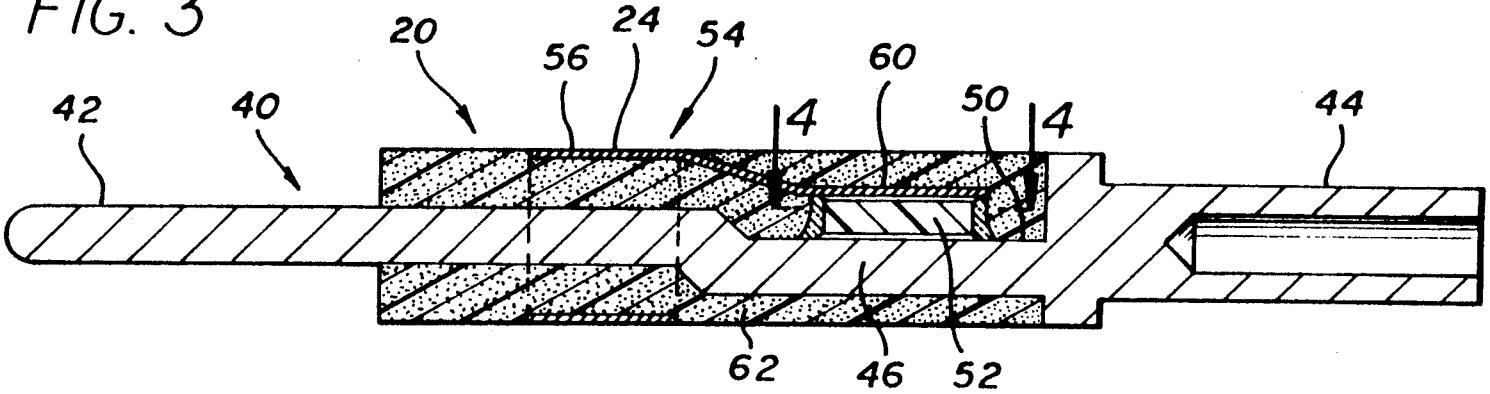
FIG. 3 is a sectional side view of the contact assembly of FIG. 2, including the encapsulant.

FIG. 1 illustrates a connector 10 which includes a housing 12 that comprises a metal shell 14 and insulators 16–18 lying within the shell. A plurality of contact assemblies such as assembly 20 are mounted in the housing. The contact assembly 20 includes an exposed grounding surface 24 which is grounded to the housing 12 by a grounding spring 26. The grounding spring 26 can be of the type shown in U.S. Pat. No. 3,569,915 which is formed of sheet metal and includes resilient inner tines 30 which press against the grounding surface 24, and resilient outer tines 32 which press against an inner surface of the housing 12. A retention clip 34 retains the connector assembly in the housing, but can be deflected out of the way by a special tool. This enables the connector assembly to be withdrawn in the rearward direction R out of the housing, to allow another contact assembly to be installed in its place.

FIG. 3 illustrates details of the contact assembly 20, which includes a contact 40 having forward and rearward portions 42, 44 and a middle 46. The middle 46 forms a platform 50 which holds a circuit component 52. A grounding conductor 54 has a sleeve-shaped forward portion 56 whose outside forms the exposed grounding surface 24 that is engaged by the grounding spring. The grounding conductor also has a rearward portion 60 in the form of a finger, which engages the circuit component 52. An encapsulant 62 surrounds the middle 46 of the contact including the platform thereof, the circuit component 52, and the rearward portion 60 of the grounding conductor. The encapsulant also includes a portion lying within the sleeve-shaped forward portion 56 of the grounding conductor to support it on the contact. This general construction of the contact assembly is shown in U.S. Pat. No. 4,954,794 by applicants and others.

The circuit component 52 is any of a variety of two-terminal devices. The most common such component is a Zener diode for suppression of stray surges such as from large electromagnetic pulses in the environment. Another type of component can be a resistor for matching line impedance. A "circuit component" is a device that significantly alters the characteristic of a variable current passing therethrough or passing in a path adjacent to the component.

Figure 5:
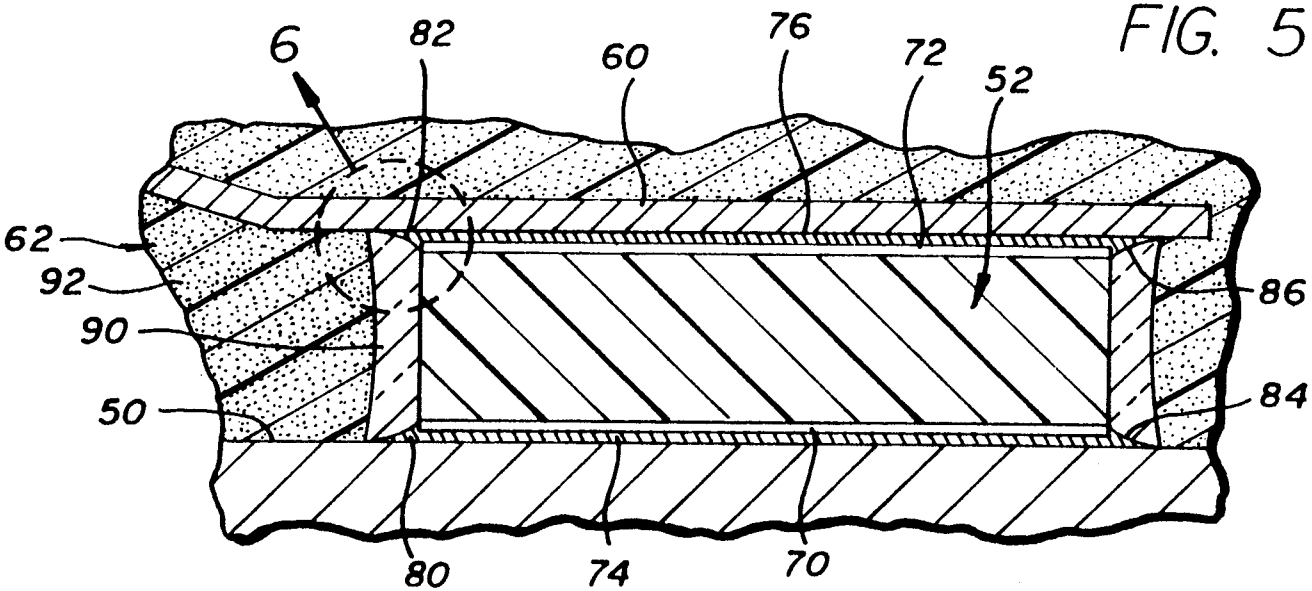
FIG. 5. is an enlarged view of a portion of the contact assembly of FIG. 3.
Figure 4:
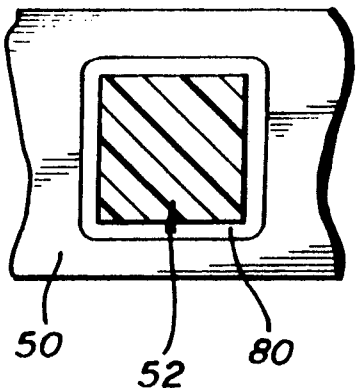
FIG. 4 is a view taken on the line 4—4 of FIG. 3, but without the encapsulant.
Figure 7:
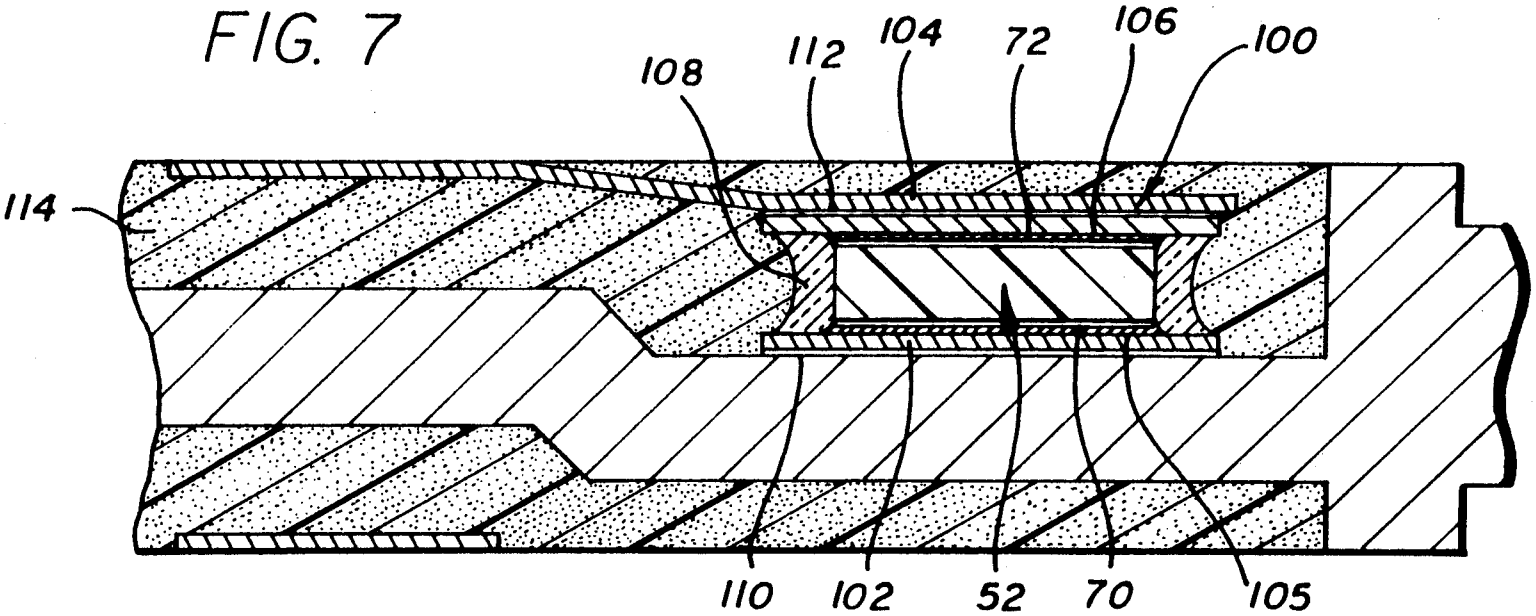
FIG. 7 is a partial sectional view of a contact assembly constructed in accordance with another embodiment of the invention.

As shown in FIG. 5, the circuit component 52 has bottom and top terminals 70, 72. The bottom terminal is mechanically and electrically joined to the platform through a lower coupling layer 74, while the top terminal 72 is mechanically and electrically joined to the rearward portion 60 of the grounding conductor by an upper coupling layer 76. The particular coupling layers 74, 76 are layers of high temperature melting solder. Each of the coupling layers 74, 76 overhangs the corresponding terminal 70, 72 of the circuit component, to leave a surrounding layer portion 80, 82 which lies on a region 84, 86 of the platform or grounding conductor rearward portion which surrounds the corresponding terminal 70, 72. The encapsulant 62 includes a moisture-proof inner portion 90 which surrounds the circuit component 52 and which extends between and bonds to both surrounding portions 80, 82 of the coupling layers 74, 76. The encapsulant includes an outer portion 92 which lies around the inner encapsulant portion 90 as well as around the grounding conductor rearward portion and the platform of the contact.

In prior contact assemblies such as described in our earlier U.S. Pat. No. 4,954,794, a mass of epoxy was used as a single encapsulant. Epoxy will bond to a wide variety of surfaces. The grounding conductor 54 and the contact 40 are preferably gold plated for high corrosion resistance. Gold has a low surface energy so it is difficult to bond to, but epoxy will bond to it to form a mechanically durable connector assembly which resists cracking. However, moisture can slowly permeate through epoxy to the circuit component, and adversely affect its characteristics. Other encapsulant materials are available which are moisture proof, but which do not have the mechanical durability of epoxy.

Applicant constructs the encapsulant so that it includes a moisture-proof inner portion 90. A suitable encapsulant includes low melting temperature glass powder held by a binder such as an organic binder or alcohol. Corning Glass Company supplies such glass-based encapsulant. However, such moisture-proof encapsulants generally will not bond to gold. Solder has a high surface energy so it is easily bonded to. A "high surface energy" may be defined as a surface having at least as much surface energy as solder (an alloy of tin and lead), and therefore is easily bonded to a liquid of low to moderate surface tension (such as molten glass). A low surface energy is less bondable, and may be defined as a surface whose energy is at least as low as that of gold, and therefore which cannot be easily bonded to liquids of moderate surface tension.

Applicant's provision of the surrounding layer portions 80, 82 of solder which bond to the gold on the grounding conductor and on the contact platform including the regions 84, 86 thereof, provides a high energy surface for the moisture-proof inner portion 90 of the encapsulant to bond to. Although the inner portion 90 also can bond to the outside of the circuit component 52, this is not necessary, as it is only necessary that the top and bottom of the encapsulant inner portion 90 each bond to a surface (regions 84, 86) that overhangs a corresponding terminal 70, 72 of the circuit component. The encapsulant includes an outer portion 92 formed of a durable easily bonded material such as epoxy. Although moisture can migrate through epoxy, the moisture-proof inner portion 90 which completely seals the circuit component (in conjunction with the upper surface of the platform and lower surface of the grounding conductor rearward portion) prevents any such moisture from reaching the circuit component.

FIG. 2 shows an early step in the construction of the contact assembly, which includes laying lower and upper solder preforms 94, 96 as shown, and installing the grounding conductor 54, so the circuit component 52 and preforms are sandwiched between the platform 50 and the rearward portion 60 of the grounding conductor. Heat is applied to melt the solder preforms to form the lower and upper coupling layers. In the prior art, solder preforms have been used to mount and connect to the terminals of circuit components such as the illustrated diode. However, in that case, the preforms were of the same width W and length L as that of the circuit component, and the layer of solder in the final joint had substantially the same width and length as that of the terminals as there was no need for any overhang. In the present invention, however, applicant constructs each preform so its width W and length L are each at least about 8% greater than that of the width X and length Y of the circuit component terminals. This provides a considerable overhang A (FIG. 6) of at least about 4% of the corresponding component dimension. Such overhang provides a wide enough surrounding layer portion 82 for good bonding of the inner portion of the encapsulant.

The solder preforms 94,96 have a thickness of between 1.5 and 2.0 mils (one mil equals one thousandth inch). This is a "standard" thickness of solder preforms used by applicant to solder small parts. The particular diode 52 is such a part, and may have a width and length such as 50 mils each, or may be rectangular with a width and length such as 50 mils and 100 mils respectively. The "standard" thickness solder preform will have substantially the same width and length after reflow soldering as before.

Applicant can instead use a thick solder preform of twice the "standard" thickness, such as one of 3 to 4 mils thickness, or two stacked "standard" thickness preforms, for each joint. Applicant finds that such thick preform expands in width and length when it is melted during reflow soldering, by perhaps 16%, as surface tension draws its edges along the grounding conductor and platform. Accordingly, applicant can use a thick preform of the same width and length as the diode component terminals, to help align them, which results in the considerable solder overhang after reflow soldering.

The particular encapsulant inner portion that applicant has used includes a low melting temperature glass power supplied by Corning Glass Company, which has a melt temperature of about 550° F. Applicant constructs the solder preforms of a high temperature melting solder such as one composed of 95% lead and 5% tin, which melts at a temperature of 594° F. First the solder preforms 94, 96 are melted by a high temperature such as about 600° F. Then the encapsulant inner portion 90 is applied as through nozzles, with a vacuum being applied to prevent the presence of air bubbles. The encapsulant inner portion 90 is then melted, or cured, at a temperature of about 550° F., which does not melt the high temperature solder of the lower and upper coupling layers 74, 76. Thereafter, the contact assembly is placed in a mold and epoxy is injected to fill the rest of the volume to be occupied by encapsulant.

FIGS. 7–10 illustrate another embodiment of the invention, which uses a component unit 100 that includes the circuit component 52 and bottom and top metal coupling plates 102, 104. The coupling plates 102, 104 have been presoldered by solder layers 105, 106 to the terminals 70, 72 of the component 52. Each of the coupling plates 102, 104 has a core 101 that has a melting temperature which is far above the usual solder temperature (which is a maximum of about 600° F.). Applicant constructs each coupling plate with the core 101 formed of a sheet of copper with a nickel plate around the copper, and a gold plate around the nickel. Each plate also includes a layer 103 of high temperature solder (melting temperature such as 600° F.) around the gold layer. Thus, the outer surface of each coupling plate has a high energy surface (of solder). It is possible to use the solder layers on the coupling plates 102, 104 to join to the circuit component terminals 70, 72. It is also possible to not solder-coat the entire coupling plates 102,104, but to use an overhanging solder layer at 105 and 106. The component unit is shown at 100A in FIG. 8, before the encapsulant has been applied.

Figure 9:
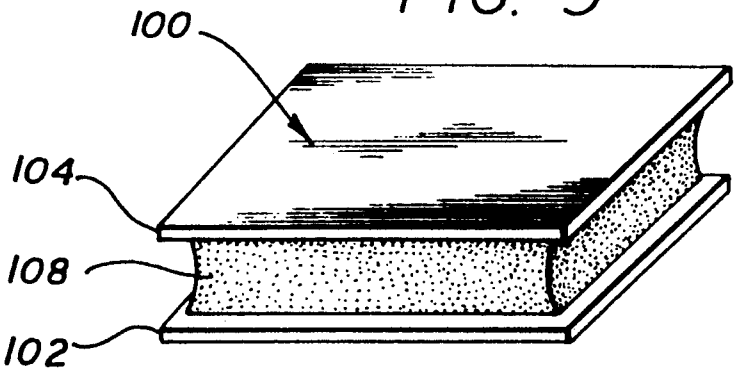
FIG. 9 is a view of the component unit of FIG. 8, with the encapsulant thereon.
Figure 8:
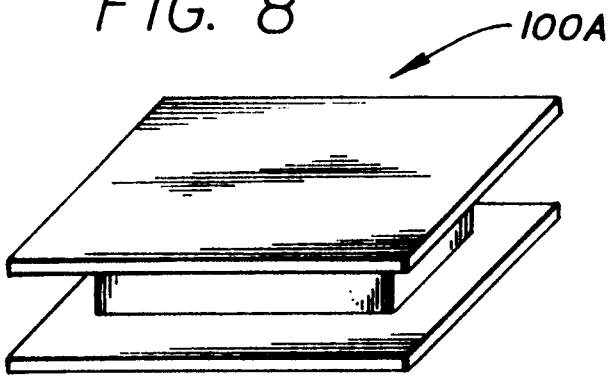
FIG. 8 is an isometric view of the component unit of the connector assembly of FIG. 7, but without the encapsulant thereon.

After the coupling plates have been attached to the terminals of the circuit component, a quantity of moisture-proof encapsulant 108 is applied around the circuit component and bonds to the inner faces 109 of the upper and lower plates (which are the plate faces that face each other). The encapsulant, such as one of low melting temperature glass powder with a binder of the type described above, is fired at a temperature such as 550° F. to cure (melt) the inner encapsulant (usually without melting the high temperature solder which holds the plates to the component terminals). The complete unit shown at 100 in FIG. 9, is placed between the platform and grounding conductor rearward portion, with preforms or layers 110, 112 (FIG. 7) placed to solder the plates in place. The particular solder layers 110, 112 are of low temperature melting solder, such as type SN 62 which includes 38% lead and 62% tin, and which melts at a temperature of 372° F. It is noted that the solder layers 110, 112 do not overhang, or extend substantially beyond, the metal coupling plates 102, 104, since they are not used as adhering surfaces to which encapsulant adheres. After the unit is soldered in place, outer encapsulant 114 such as epoxy, is molded around the middle of the contact assembly to complete it.

FIG. 11 shows a component unit 120 which is a variation of the unit of FIGS. 7–10, in that it includes an inner encapsulant 122 which adheres to the peripheral surfaces 124, 126 of bottom and top metal coupling plates 130, 132 of the same construction as plates 102, 104. The inner encapsulant 122 is applied in the form of a band which closely surrounds the peripheries of the coupling plates, and which is shrunk to a shrink fit thereon. The inner encapsulant 122 is then cured (melted), usually at a temperature below the melting temperature of solder joints 134, 136 of high temperature melting material which joins the component terminals to the coupling plates. It is noted that it is possible to use a higher encapsulant cure temperature, which will also melt the solder. The unit 120 can be used in place of the component unit 100 of FIG. 7.

Figure 12:
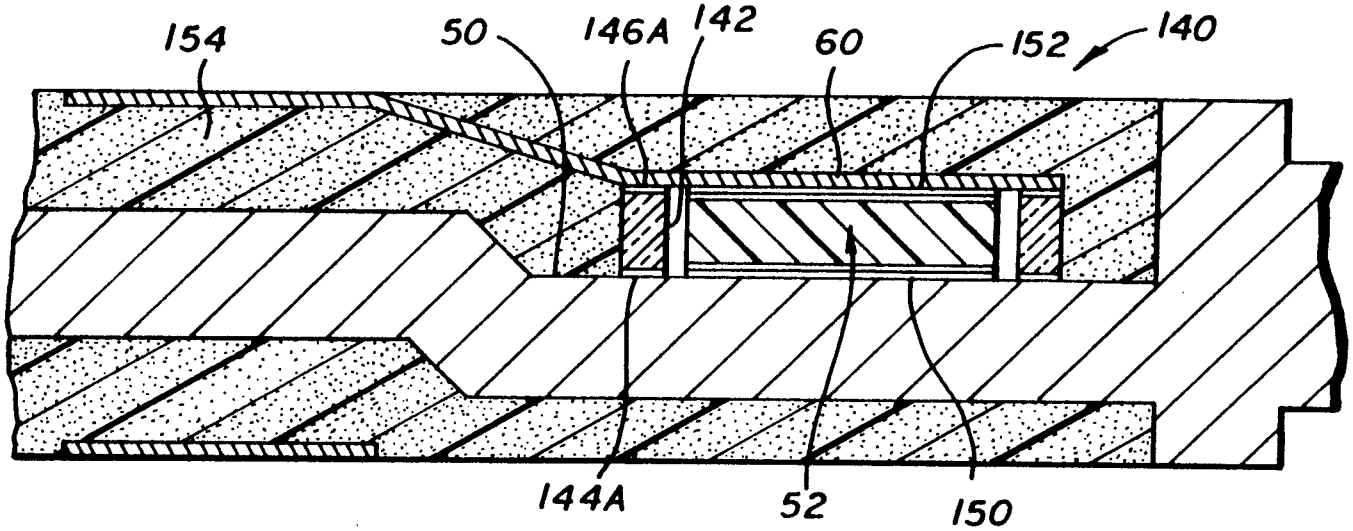
FIG. 12 is a sectional side view of a contact assembly constructed in accordance with another embodiment of the invention, which includes a barrier around the component.

FIGS. 12 and 13 illustrate another embodiment of the invention, wherein the inner encapsulant is in the form of a substantially rigid barrier 142 having the same height as the circuit component 52. As shown in FIG. 13, applicant constructs the barrier 142 of a moisture-proof material such as ceramic, and applies preforms 144, 146 of low melting temperature solder thereto. Applicant also applies preforms to the bottom and top terminals of the contact device 52, although a single top preform and single bottom preform can be used to join both a component terminal and a barrier end to the grounding conductor or to the platform. With the barrier 142 and contact device in place, and the preforms in place, applicant remelts the preforms. In the final assembly, solder joints 150, 152 join the component terminals to the platform 50 and to the grounding conductor rearward portion 60, while additional solder joints 144A, 146A join the bottom and top surfaces of the barrier 142 to the platform and grounding conductor. The barrier 142 is not bonded to the circuit component 52, but, in conjunction with the platform and grounding conductor, forms a moisture-proof seal extending completely around the circuit component. An epoxy encapsulant outer portion 154 encapsulates the parts as in the earlier-described embodiments.

Figure 14:
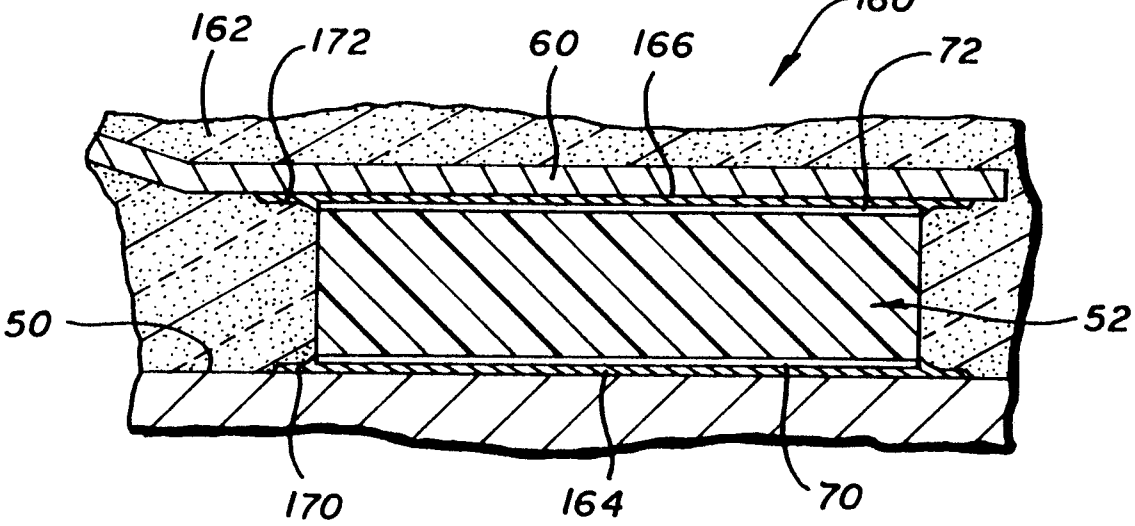
FIG. 14 is a partial sectional view on a contact assembly constructed in accordance with another embodiment of the invention.

FIG. 14 illustrates a portion of a contact assembly 160 wherein a single moisture-proof encapsulant 162 is used. The terminals 70, 72 of the contact device 52 are joined to the platform 50 and grounding conductor rearward portion 60 by coupling layers 164, 166 of solder having a high melting temperature (e.g. 590° F.), and with the layers having surrounding layer portions 170, 172 of the same relative dimensions as those shown at 80, 82 in FIG. 5. That is, the surrounding portions 170, 172 considerably (at least about 4%) overhang the terminals of the circuit component. As a result, the encapsulant 162 bonds to the surrounding portions 170, 172 to form good moisture-tight seals thereat. The rest of the encapsulant extends to the same locations as the encapsulant 62 in FIG. 3. The encapsulant 162 comprises low melting temperature glass powder in a binder, of the type described above, which is cured at a temperature such as about 550° F. The advantage of using a single encapsulant 162 is that it can be molded in place in a single operation. The disadvantage is that encapsulant material that is moisture proof, is generally not as mechanically durable, so it is prone to cracking, as compared to the more durable epoxy encapsulant material.

Although terms such as "bottom", "top", etc. have been used to aid in the description of the drawings, it should be understood that connector and the contact assemblies and its parts can be used in any orientation with respect to gravity.

Thus, the invention provides a connector and contact assemblies therefor, of the type which includes a circuit component, which hermetically seals the circuit component to keep out moisture. This is accomplished by providing a moisture-proof inner encapsulant portion surrounding the component. In most embodiments of the invention, the bottom and top terminals of the encapsulant are joined to the platform of the contact and to the rearward portion of the grounding conductor, by a coupling layer of high surface energy which overhangs the terminal, preferably by at least 4% of the terminal width and length, to provide a surrounding region of the coupling plate which has a high surface energy. The inner portion of the encapsulant bonds to the surrounding high surface energy portions, to seal the circuit component from moisture. A separate encapsulant can be applied around the inner portion, with the outer portion of the encapsulant being highly mechanically durable, even though it may not be moisture proof. The coupling layer can be formed by overhanging areas of solder (a combination of tin and lead), or can be separate solder-coated plates which are themselves soldered to a component terminal and to the platform or grounding conductor. The inner encapsulant can be a rigid barrier which is not bonded to the circuit component, but which lies around the circuit component and is soldered to the platform and grounding conductor.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. A connector which has a housing and a plurality of contact assemblies in said housing, wherein a first of said contact assemblies includes a contact with opposite ends and with a middle that forms a platform, a circuit component mounted on said platform and having first and second terminals with said first terminal electrically connected to said platform, a ground conductor having a sleeve-shaped forward portion surrounding said contact but out of engagement therewith and a rearward portion electrically connected to said second terminal of said component, and a quantity of encapsulant lying around at least part of said contact middle, said encapsulant having a portion lying within said sleeve-shaped forward portion of said ground conductor and around said contact middle but leaving the outside of said sleeve-shaped portion exposed, and said encapsulant having a portion lying around said component and around said ground conductor rearward portion, characterized by:

a lower coupling layer having a high surface energy, which mechanically and electrically joins said first terminal to said platform, and which includes a surrounding layer portion which lies in a region of said platform which surrounds said first terminal;

an upper coupling layer having a high surface energy which mechanically and electrically joins said second terminal to said rearward portion of said ground conductor, and which includes a surrounding layer portion which lies on a region of said rearward portion of said ground conductor which surrounds said first terminal;

said encapsulant includes a moisture-proof inner portion which surrounds said component and which extends between and bonds to said surrounding layer portions of both said lower layer and said upper layer.

2. The connector described in claim 1 wherein:

said encapsulant includes an outer portion which surrounds said inner portion, said inner and outer portions being constructed of different materials, with the material of said inner portion being less bondable but more resistant to the passage of moisture therethrough, than the material of said outer portion.

3. The connector described in claim 1 wherein:

said upper and lower layers comprise top and bottom metal coupling plates;

said circuit component has substantially flat top and bottom terminal surfaces, and said top and bottom coupling plates each is mechanically and electrically joined in a solder joint to a corresponding one of said terminal surfaces, with each coupling plate having a greater width and length than said terminal surfaces to leave overhanging regions that overhang said terminal surfaces, and with each coupling plate being joined in a solder joint respectively to said platform and to said ground conductor rearward portion;

said inner portion of said encapsulant surrounds said component and bonds to said overhanging regions of said coupling plates.

4. The connector described in claim 3 wherein:

said coupling plates have inner faces facing each other;

said inner portion of said encapsulant bonds to said inner faces of said coupling plates.

5. The connector described in claim 3 wherein:

said coupling plates have peripheral surfaces;

said inner portion of said encapsulant comprises a band which has upper and lower portions that press against and bond said peripheral surfaces of said top and bottom plates.

6. The connector assembly described in claim 1 wherein:

said top and bottom terminals are each substantially rectangular with a width and length, as seen respectively in a top view, and said upper and lower layers each has a width and length at least 8% greater than the width and length of the corresponding terminal to overhang the corresponding terminal by at least about 4% of the width and length of the terminal.

7. The connector described in claim 1 wherein:

said coupling layers have solder at their surfaces, and said encapsulant inner portion includes melted glass powder.

8. A method for constructing a component-holding contact assembly which includes a contact having a platform, by mounting a circuit component with top and bottom terminals on said platform with said bottom terminal electrically coupled to said platform, mounting a finger of a ground conductor rearward portion to said second terminal where said grounding conductor has a sleeve-shaped forward portion with an outer surface of low surface energy, and establishing an encapsulant around said component, said platform, and said finger of said ground conductor, characterized by:

establishing a bottom layer of high surface energy between and joined to said component bottom terminal and said platform, and establishing a top layer of high surface energy between and joined to said component top terminal and said finger of said ground conductor, wherein each of said layers extends horizontally beyond the corresponding component terminal by at least 4% of the horizontal width and length of the component to leave an overhanging layer region;

said step of establishing an encapsulant includes applying an inner encapsulant portion of moisture proof material around said component and in bonding engagement with said overhanging layer regions of said bottom and top layers of high surface energy material.

9. The method described in claim 8 wherein:

said step of establishing an encapsulant includes molding a second encapsulant material which is less moisture resistant than the material of said inner encapsulant portion, around said inner encapsulant and around said finger and said platform.

10. The method described in claim 8 wherein:

said inner encapsulant portion has a predetermined minimum cure temperature;

said step of establishing a bottom layer includes laying a bottom preform of a high temperature solder material between said component bottom terminal and said platform, and said step of establishing a top layer includes laying a top preform of said solder material between said component top terminal and said finger, where said high temperature solder material melts at a predetermined solder-melt temperature which is greater than said minimum cure temperature; and including heating said preforms to at least said solder-melt temperature after laying said preforms to form joining solder layers, and thereafter applying said inner encapsulant portion and then heating said inner portion of said encapsulant as well as said component, platform finger, and said joining solder layers to a temperature between said minimum cure temperature and said solder-melt temperature.

11. The method described in claim 8 wherein:

said step of establishing bottom and top layers includes establishing a solder joint between said component bottom terminal and a top coupling plate and between said component bottom terminal and a bottom coupling plate, where each coupling plate is formed of a core plate having a higher melting temperature than said solder-melt temperature and which overhangs a corresponding one of said component terminals, and with each of said solder joints overhanging a corresponding component terminal;

said step of applying an inner encapsulant portion includes bonding said inner encapsulant to said top and bottom solder joints.

12. A contact assembly comprising:

a contact having opposite ends and a middle;

a circuit component mounted on said contact middle, said circuit component having first and second terminals, with said first terminal electrically coupled to said contact middle through a first solder joint;

a grounding conductor having a portion electrically coupled to said second terminal through a second solder joint;

each of said solder joints includes a layer of solder that has an overhanging region which extends beyond the corresponding terminal;

an encapsulant which includes an inner portion of moisture-proof material which extends around said component and which bonds respectively to said contact middle and to said grounding conductor portion.

13. The contact assembly described in claim 12 wherein:

said encapsulant includes an outer portion of a second material which is less moisture resistant than said moisture-proof material, said outer portion surrounding said inner portion, said contact middle and said rearward portion of said grounding conductor.

14. A contact assembly comprising:

a contact having opposite ends and a middle which forms a platform;

a circuit component mounted on said platform, said circuit component having top and bottom terminals;

a grounding conductor having a rearward portion electrically coupled to said second terminal;

top and bottom metal coupling plates lying respectively over and under said top and bottom terminals and joined thereto, with said top and bottom plates electrically and mechanically joined respectively to said ground conductor rearward portion and to said platform, with each of said plates having a higher surface energy than the surfaces of said contact ends;

each of said coupling plates include an overhanging region which extends beyond the corresponding terminal;

an encapsulant which includes an inner portion of moisture-proof material which extends around said component and which bonds to each of said coupling plates.

15. The contact assembly described in claim 14 wherein:

said coupling plates have inner surfaces that face each other and said inner portion of encapsulant bonds to said plate inner surfaces.

16. The contact assembly described in claim 14 wherein:

each of said coupling plates has a peripheral surface, and said inner portion of encapsulant is in the form of a band that bonds to said peripheral surfaces.

17. The contact assembly described in claim 14 wherein:

said encapsulant includes a second portion which is not as moisture proof as said inner portion and which surrounds said inner portion.

* * * * *